United States Patent [19]

Harris, Jr. et al.

[11] 4,398,495

[45] Aug. 16, 1983

[54] PAINT SHIELD

[76] Inventors: Louis W. Harris, Jr., 10225 Sunland Blvd., Sunland, Calif. 91040; Michael T. Harris, 7908 Quimby Ave., Canoga Park, Calif. 91304

[21] Appl. No.: 364,805

[22] Filed: Apr. 2, 1982

[51] Int. Cl.[3] ..... B05C 11/00

[52] U.S. Cl. ..... 118/504; 118/505; 428/131; 428/121; 428/130; 428/156

[58] Field of Search ..... 428/542.8, 131, 130, 428/121, 156, 157; 118/504, 505, 301; 156/257, 258

[56] References Cited

U.S. PATENT DOCUMENTS

| | | | |
|---|---|---|---|
| 1,287,181 | 12/1918 | Barker | 118/504 |
| 2,107,946 | 2/1938 | Inman | 229/22 |
| 2,538,743 | 1/1951 | Alston | 118/504 |
| 3,693,589 | 9/1972 | Knox | 118/504 |
| 3,788,274 | 1/1974 | McNaughton et al. | 118/504 |

FOREIGN PATENT DOCUMENTS

| | | | |
|---|---|---|---|
| 7415295 | 5/1976 | Netherlands | 118/505 |

*Primary Examiner*—Alexander S. Thomas
*Attorney, Agent, or Firm*—Ralph B. Pastoriza

[57] ABSTRACT

The paint shield comprises a thin rectangular sheet with a longitudinal crease extending in from one end terminating short of the opposite end. A transverse crease is provided which intercepts the longitudinal crease. The arrangement is such that a portion of the shield can be bent about the transverse crease to protect areas intersecting at an angle from paint, such as corner molding and the like. By flexing the shield about its longitudinal crease, the bent portion automatically snaps back into a coplanar relationship with the remaining portion of the sheet so that its maximum longitudinal length is again available for shielding while painting. Notches can be cut out from opposite ends dimensioned to snugly engage 2×4 inch rafters or 2×6 inch rafters to protect surrounding wall areas when painting the rafters.

3 Claims, 4 Drawing Figures

PAINT SHIELD

FIELD OF THE INVENTION

This invention relates to a paint shield for protecting areas from the paint when painting a home or office.

BACKGROUND OF THE INVENTION

Many different types of paint shields have been proposed heretofore and many are in use by painters. Usually such paint shields have a fairly elongated straight edge portion which can be positioned in the intersection angle between two walls or a wall and a ceiling, should it be desired to protect one wall or ceiling area from the other while painting the other. In this respect, there have even been proposed paint shields with a precreased portion such that a portion of the shield can be bent out of the plane of the remaining portion to form a right angle and thus shield a corner portion or other location where two areas intersect at an angle from paint.

While painting operations are facilitated by the type of paint shield which can be formed into a right angle, once the shield has been bent into such a configuration, it is difficult to hold the shield in an unflexed or straight relationship, wherein the bent portion is again coplanar with the remaining portion of the shield. In other words, the bent portion tends to flop about the crease line and thus the advantage of a fairly long edge portion for subsequent paint shielding is lost.

BRIEF DESCRIPTION OF THE PRESENT INVENTION

With the foregoing in mind, the present invention contemplates an improved paint shield, wherein a portion of the shield can be bent or flexed away from the remaining portion to form an angle so that areas intersecting at an angle, such as corners can be protected from paint with such a shield. In addition, however, the shield of the present invention is so designed that the bent portion can be brought back into coplanar relationship with the remaining portion very quickly and very easily and retained in such coplanar relationship so that the shield again reassumes its initial advantages of providing elongated edges for proper shielding of straight portions.

More particularly, the shield of the present invention comprises a thin rectangular sheet having a longitudinal crease extending in from one end and terminating short of the opposite end. A transverse crease, in turn, extends from one longitudinal edge to the other, this transverse crease intersecting the longitudinal crease. With this arrangement, the shield can be easily folded about the transverse crease to facilitate shielding areas that intersect at any angle. In addition, the bent portion of the shield can be easily and automaticaly snapped back to its coplanar relationship with the remaining portion of the shield by flexing the shield about its longitudinal crease.

In addition to the above feature, the opposite ends of the shield can be provided with notches dimensioned to snugly engage 2×4 inch and 3×6 inch rafters respectively to shield surrounding wall areas when the rafters are being painted. Also, portions of the shield can be removed to provide convenient cut-outs to serve as handles.

BRIEF DESCRIPTION OF THE DRAWINGS

A better understanding of this invention will be had by now referring to the accompanying drawings in which:

FIG. 2 is a perspective view of the shield in FIG. 1 wherein a portion has been bent to form an angle to facilitate shielding of corners and the like;

DETAILED DESCRIPTION OF THE PREFERRED EMBODIMENT

Figure 1:
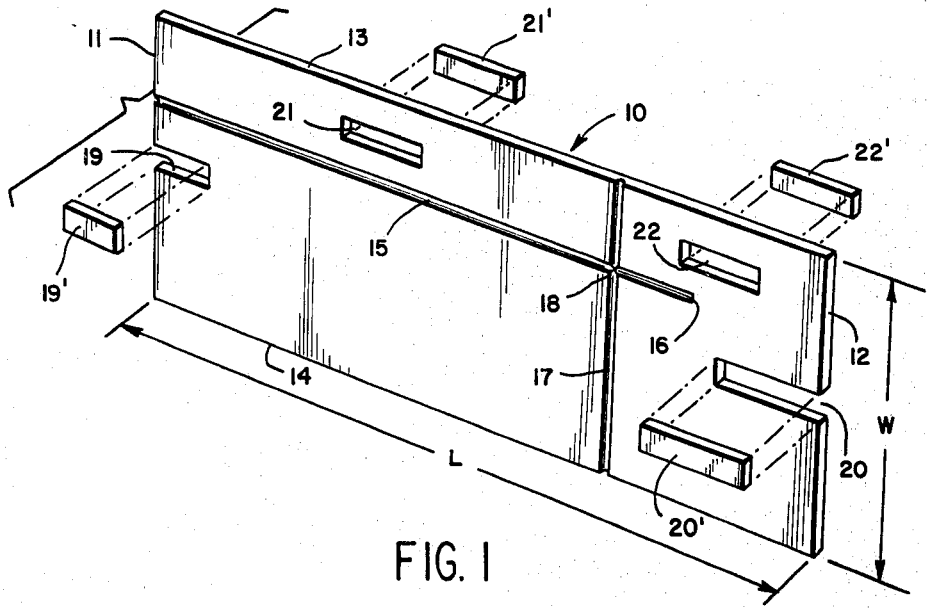
FIG. 1 is a perspective view of the improved paint shield of this invention with certain parts shown exploded away in accord with a preferred embodiment.

Referring first to FIG. 1, there is shown generally by the numeral 10 a thin rectangular sheet which may comprise cardboard, plastic, or the like. In FIG. 1 as well as the other drawings, the thickness of this sheet has been somewhat exaggerated for purposes of illustration.

Sheet 10 has opposite ends 11 and 12 of width W and opposite longitudinal edges 13 and 14 of length L. In the preferred embodiment the length L is approximate 2½ times the width W.

Sheet 10, as shown, has a longitudinal crease 15 extending in from the one end 11 past the mid-point of the sheet to terminate short of the opposite end 12 as at 16. Preferably the longitudinal crease 15 is parallel to the longitudinal edges 13 and 14 and is closer to one edge than the other such as the edge 13.

Sheet 10 also includes a transverse crease 17 extending from the one longitudinal edge 13 to the opposite longitudinal edge 14 and intersecting the longitudinal crease 15 as at 18.

Still referring to FIG. 1, the opposite ends 11 and 12 of the shield include rectangular notches dimensioned to respectively receive in snug engagement in the one end 11 a rafter of 2×4 inches in cross section and in the other end 12 a rafter of 2×6 inches in cross section.

The manner in which these notches function to facilitate shielding of paint will become evident as the description proceeds.

Finally the shield includes two longitudinally spaced cut-outs 21 and 22 adjacent the one longitudinal edge 13 to serve as handles and thereby facilitate holding of the shield. It will be noted that the transverse crease 17 passes between the cut-outs 21 and 22.

In manufacturing the shield, the same may be provided with the notches 19 and 20 and the cut-outs 21 and 22 already formed. Alternatively, the sheet may constitute a complete rectangular filled-in shape, with the notches and cut-outs outlined by perforations or scoring so that component parts can be removed to provide the notches and cut-outs respectively. For example, in FIG. 1 the removed portions from perforated or scored parts are indicated at 19' and 20' for the notches 19 and 20 and at 21' and 22' for the handle cut-outs 21 and 22.

It will be appreciated from the description thus far, that the entire rectangular shield 10 can be easily manipulated by grasping either or both of the handle cut-outs 21 and 22 and positioning the lower longitudinal edge 14 against intersecting surfaces or on top of moldings and the like to protect the same from paint.

Figure 2:
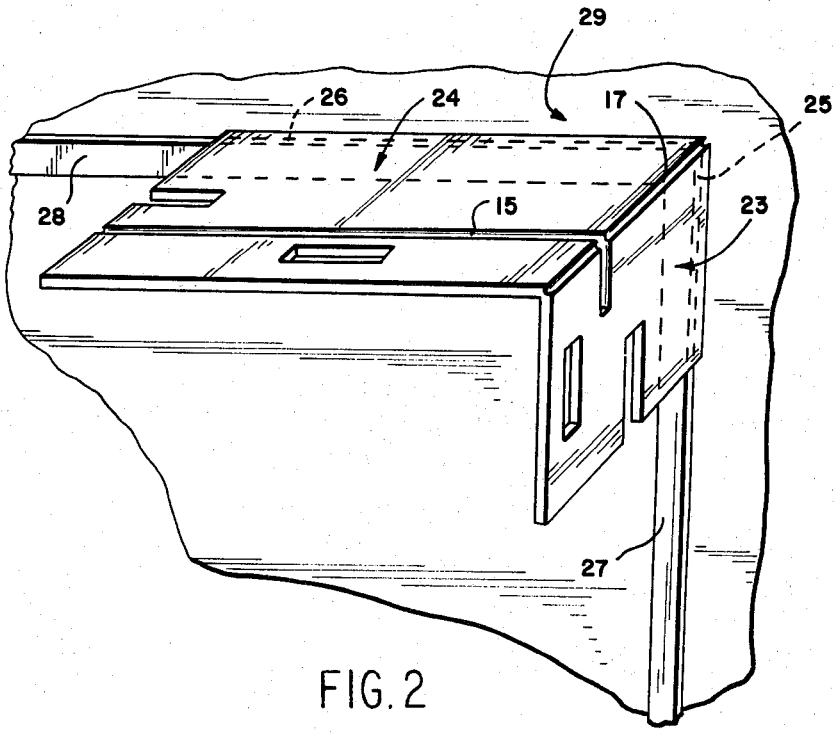

Referring now to FIG. 2, there is illustrated a further function of the shield of FIG. 1 wherein corner areas can be protected. Thus, the shield is shown bent about the transverse crease 17, the bent portion being indicated at 23 and the remaining horizontal portion of the shield as viewed in FIG. 2 being indicated at 24. In the example illustrated, the shield is used to protect the side and top areas 25 and 26 of molding 27 and 28, respectively. This molding might be part of the frame of a door or window. In the example illustrated, the shield is bent about the transverse crease line 17 to form a right angle configuration and thereby conform with the corner of the molding. The wall area above and to the right of the molding indicated generally by the numeral 29 can then be painted and the molding surfaces 25 and 26 protected.

It is also possible, of course, in the right angle configuration of the shield as shown in FIG. 2, to protect the ceiling and intersecting wall from paint when an adjacent wall is to be painted. Thus, it is only necessary to nest the transverse crease or fold line 17 in the corner where the one wall and ceiling intersect leaving beneath the shield the wall to be painted.

While the above two examples concern a right angle configuration between the shield portions 23 and 24, it should be understood that other angles can readily be formed anywhere from zero to 180° in the event that intersecting areas form angles different from 90°.

After the shield has been flexed about the transverse axis 17 a large number of times, there is a tendency for the portion 23 to flap or move fairly easily with respect to the remaining portion 24.

In accord with an essential feature of the present invention, the bent portion 23 can easily and quickly be brought back into stiff coplanar relationship with the remaining portion 24 by the provision of the longitudinal crease 15. Thus, it is only necessary for the painter to flex the shield about the longitudinal crease 15 when the bent portion 23 forms any angle whatsoever with the remaining portion 24 and this action will immediately snap the bent portion 23 into coplanar relationship with the remaining portion 24.

Figure 3:
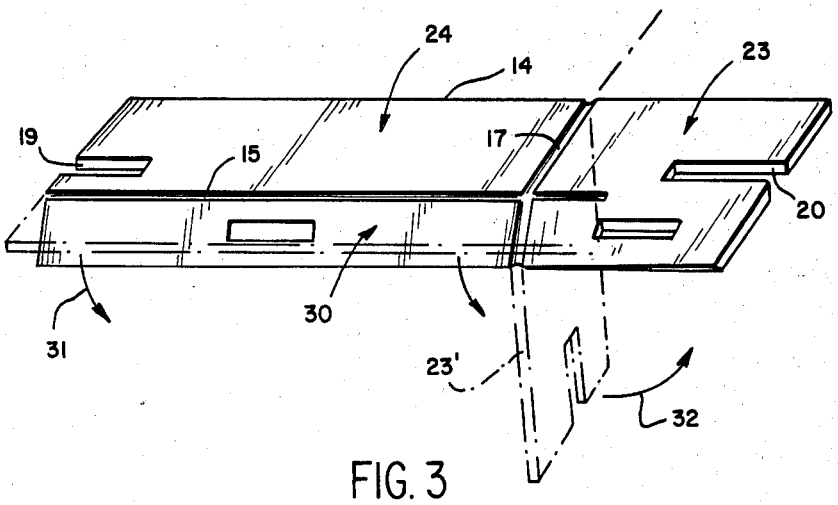
FIG. 3 is a perspective view of the shield illustrating the manner in which a previously bent portion is brought back into coplanar relationship with the remaining portion of the shield; and, FIG. 4 is a perspective view illustrating the manner in which wall portions adjacent to rafters can be protected by means of the shield of this invention.

The foregoing will be better understood by referring to FIG. 3 wherein there is illustrated a portion 30 of the remaining portion 24 being flexed downwardly as indicated by the arrow 31 about the longitudinal crease 15. This action can only take place when the bent portion illustrated in phantom lines at 23' is moved into its solid line showing in FIG. 3 at 23 wherein it lies in the same plane as the remaining portion 24. The snapping upwardly of the bent portion from its phantom line position 23' to its solid line position 23 as the portion 30 is bent in the direction of the arrow 31 is indicated by the arrow 32.

So long as the painter maintains a slight flexing of the entire shield about the transverse crease 15, the portion 23 will remain in a rigid relationship with respect to the remaining portion of the shield 24. As a consequence, the longitudinal edge 14 shown in FIG. 3 can be used to maximum advantage as described with respect to FIG. 1.

Figure 4:
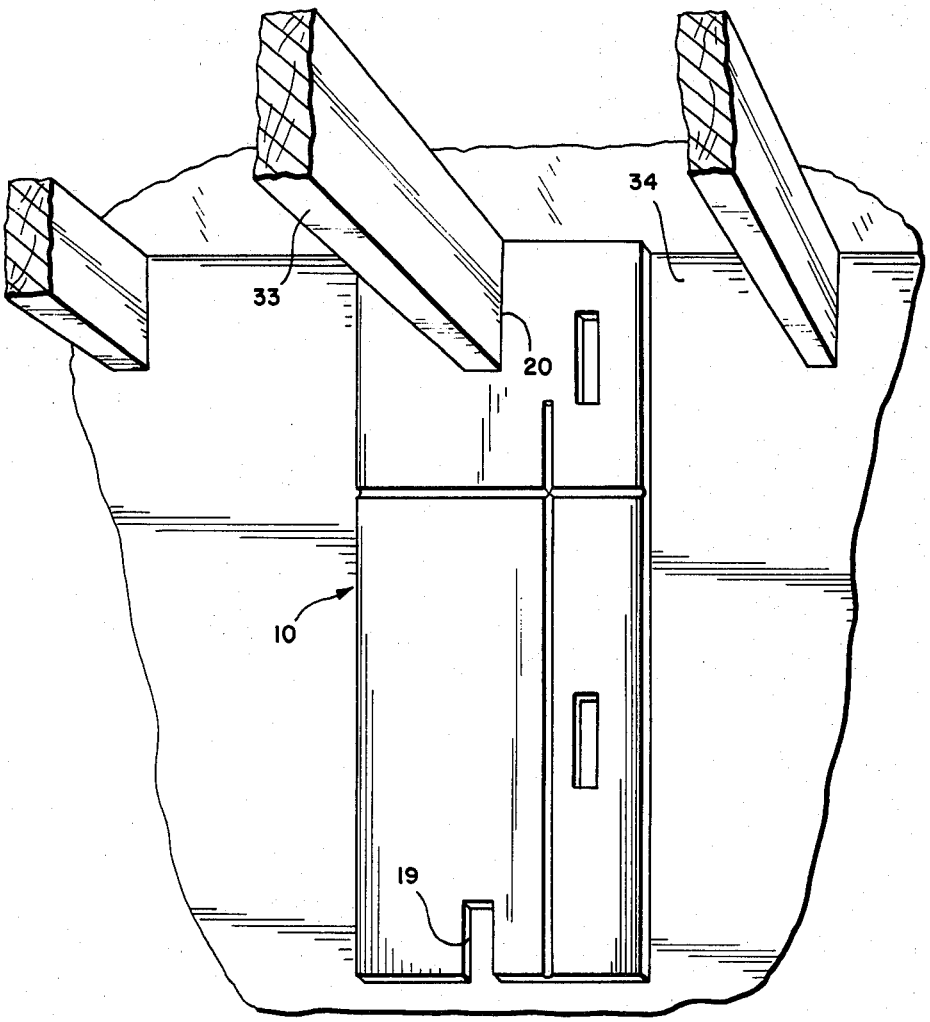

Referring now to FIG 4, there is shown yet another feature of the shield of this invention wherein the manner in which one or the other of the notches described in FIG. 1 can be used to facilitate the painting of rafters. Thus, there is shown a rafter 33 in FIG. 4 which, by way of example, constitutes a 2×6 inch beam. For this particular dimension beam, the notch 20 described in FIG. 1 is simply positioned to receive the rafter 33 in a snug relationship where it intercepts the wall 34. It can now be appreciated that a painter can paint the rafter without any fear of getting paint on the wall surface 34 surrounding the rafter 33.

In the event that the rafter is 2×4 inches, then the other notch 19 would be used.

Of course these notches can also be used where studs, joists, and the like are involved or any other parts conforming to the dimensions described are to be painted.

From all of the foregoing, it will now be evident that the present invention has provided a greatly improved paint shield wherein not only is the painting of corner areas greatly facilitated but the shield itself does not lose its usefulness after being flexed many times about a transverse axis because of the unique longitudinal crease for maintaining the bent portion in a desired coplanar relationship when the device is to be used as a straight shield.

Minor modifications falling within the scope and spirit of this invention will occur to those skilled in the art. The paint shield, accordingly, is not to be thought of as limited to the exact embodiment disclosed merely for illustrative purposes.

We claim:

1. A paint shield comprising a thin rectangular sheet having a longitudinal crease extending in from one end past the mid-point of said shield and terminating short of the opposite end, and a transverse crease extending from one longitudinal edge to the other, said transverse crease crossing said longitudinal crease so that the terminal end of said longitudinal crease lies between said transverse crease and said opposite end, said shield further including two longitudinally spaced cut-outs adjacent one longitudinal edge of the shield to serve as handles to facilitate holding the shield, said transverse crease passing between said cut-outs, whereby the portion of said shield to one side of said transverse crease can be easily bent about said transverse crease, out of the plane of the remaining portion of the shield to facilitate shielding areas that intersect at an angle, and whereby the bent portion of the shield can be easily and automatically snapped back to its coplanar relationship with the remaining portion of the shield by flexing the shield about said longitudinal crease.

2. A shield according to claim 1, including rectangular notches extending into opposite ends of said shield dimensioned to respectively receive in snug engagement in one end a rafter of 2×4 inches cross section and in the other end a rafter of 2×6 inches cross section, to shield surrounding wall areas when a rafter is being painted.

3. A shield according to claim 1, in which the length of the shield is approximately 2½ times its width and wherein said transverse crease is positioned such that said bent portion is approximately ⅓ the entire area of said shield.

* * * * *